US007586469B2

(12) United States Patent
Fujisawa et al.

(10) Patent No.: US 7,586,469 B2
(45) Date of Patent: Sep. 8, 2009

(54) ORGANIC EL DRIVE CIRCUIT AND ORGANIC EL DISPLAY DEVICE USING THE SAME ORGANIC EL DRIVE CIRCUIT

(75) Inventors: Masanori Fujisawa, Kyoto (JP); Shinichi Abe, Kyoto (JP); Hiroshi Yaguma, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 756 days.

(21) Appl. No.: 11/127,249

(22) Filed: May 12, 2005

(65) Prior Publication Data

US 2005/0259050 A1 Nov. 24, 2005

(30) Foreign Application Priority Data

May 12, 2004 (JP) ..... 2004-141891

(51) Int. Cl.
*G09G 3/30* (2006.01)

(52) U.S. Cl. ..... 345/76; 345/77

(58) Field of Classification Search ..... 345/204, 345/76, 690, 77; 315/169.3, 169.4; 365/189.09
See application file for complete search history.

(56) References Cited

U.S. PATENT DOCUMENTS

| | | | | |
|---|---|---|---|---|
| 7,084,577 | B2 * | 8/2006 | Maede et al. | 315/169.4 |
| 7,292,234 | B2 * | 11/2007 | Kitahara | 345/204 |
| 2003/0223275 | A1 * | 12/2003 | Abe | 365/189.09 |
| 2004/0032217 | A1 * | 2/2004 | Abe et al. | 315/169.3 |
| 2004/0155840 | A1 * | 8/2004 | Abe et al. | 345/76 |
| 2004/0169478 | A1 * | 9/2004 | Maede et al. | 315/169.3 |
| 2005/0024300 | A1 * | 2/2005 | Abe et al. | 345/76 |
| 2005/0237284 | A1 * | 10/2005 | Yaguma et al. | 345/76 |
| 2006/0017670 | A1 * | 1/2006 | Yaguma | 345/77 |
| 2007/0152935 | A1 * | 7/2007 | Maede et al. | 345/92 |

FOREIGN PATENT DOCUMENTS

| | | |
|---|---|---|
| JP | 2001-42827 | 2/2001 |
| JP | 2003-288045 | 10/2003 |

* cited by examiner

*Primary Examiner*—Amr Awad
*Assistant Examiner*—Tony Davis
(74) *Attorney, Agent, or Firm*—Mattingly & Malur, P.C.

(57) ABSTRACT

A current inputted from a first input terminal and a reference current generated by an internal reference current generator circuit, which are in phase, are inputted to a reference current selector circuit by which either the inputted current or the reference current is selected. The selected current is temporarily phase-inverted by a current inverter circuit and drives a current mirror circuit of a current distributor circuit (or a reference current regulator circuit) for duplicating the reference current and distributing them. Currents, each of which is in phase with the reference current or the inputted current and has same current value as that of the reference current or the inputted current, can be generated in the output side transistors of the current mirror circuit. In order to realize this, a second output side transistor is provided in the current mirror circuit so that a current, which is in phase with the reference current and has substantially equal value to that of the selected current, is supplied from the output terminal to a next stage integrated circuit as an input reference current.

20 Claims, 3 Drawing Sheets

PAGE 3/10 * RCVD AT 12/3/2008 4:16:31 PM [Eastern Standard Time] * SVR:USPTO-EFXRF-4/14 * DNIS:2738300 * CSID:703 684 1159 * DURATION (mm-ss):14-18

ORGANIC EL DRIVE CIRCUIT AND ORGANIC EL DISPLAY DEVICE USING THE SAME ORGANIC EL DRIVE CIRCUIT

BACKGROUND OF THE INVENTION

1. Field of the Invention

The present invention relates to an organic EL drive circuit and an organic EL display device using the same organic EL drive circuit and, in particular, to an organic EL drive circuit and an organic EL display device, which can reduce unevenness of luminance on a display screen of an organic EL panel of the organic EL display device used in a portable telephone set, etc., due to difference in characteristics between column driver IC's, can reduce manufacturing cost of the column driver IC's and, particularly, is suitable for high luminance color display.

2. Description of the Related Art

An organic EL display panel of an active or passive type organic EL display device for use in a portable telephone set including 396 (132×3) terminal pins (column pins) for column lines (anode side drive lines of organic EL elements or data lines) and 162 terminal pins for row lines has been proposed. These numbers of the terminal pins for column lines and row lines are still increasing.

With such increase of the number of terminal pins, a plurality of column driver IC's becomes necessary on, particularly, the column line side.

For example, in a full color QVGA, the number of terminal pins for each of the three primary colors becomes 120, so that a total of 360 terminal pins are necessary, that is, three column driver IC's are presently necessary. Therefore, there is a problem that unevenness of luminance appears on a display screen of an organic EL display device, due to difference in characteristics between column driver IC's and, particularly, due to variation of drive currents of the column driver IC's.

For example, JP2001-42827A discloses a technique for solving the above problem.

FIG. 3 is a circuit diagram disclosed in JP2001-42827A. In FIG. 3, an initial stage column driver IC (a first anode line drive circuit of a master chip) 21 includes a reference current control circuit RC, a control current output circuit CO, a switch block SB having switches S1 to Sm and circuits composed of transistors Q1 to Qm and bias resistors R1 to Rm and provided correspondingly to the terminal pins as m current drive sources. A next stage column driver IC (a second anode line drive circuit of a slave chip) 22 includes a drive current control circuit CC, a switch block SB having switches S1 to Sm and circuits composed of transistors Q1 to Qm and bias resistors R1 to Rm and provided correspondingly to the terminal pins as m current drive sources. The m current drive sources are constructed with transistors Q1 to Qm and resistors R1 to Rm, respectively. Output currents I of the transistors Q1 to Qm of the drivers are supplied to the pins through the switches S1 to Sm and output terminals X1 to Xm, respectively.

The reference current control circuit RC is constructed with an operational amplifier OP supplied with a reference voltage VREF, a transistor Qa, which is driven by an output of the operational amplifier OP supplied to a base thereof, a resistor Rp provided between an emitter of the transistor Qa and ground and a transistor Qb having a collector connected to a collector of the transistor Qa on an upstream side of the transistor Qa. A voltage generated by the resistor Rp is fed back to an input of the operational amplifier OP, so that the reference current control circuit constitutes a constant current source. An emitter of the transistor Qb is connected to a power source line VBE (corresponding to a power source line VDD of the display device) through a resistor Rr.

A current mirror circuit is constructed with the transistor Qb as an input side transistor and the transistors Q1 to Qm and a transistor Qo of the control current output circuit CO as output side transistors. The transistor Qb is driven by a reference current IREF generated by the reference current control circuit RC.

The drive current control circuit CC of the column driver IC 22 corresponds to the reference current control circuit RC. The drive current control circuit CC is constructed with a current mirror circuit including transistors Qc and Qd and a transistor Qe driven by the output side transistor Qd of the current mirror circuit. The input side transistor Qc of the column driver IC 22 is supplied with an output current Iout=ic of the control current output circuit CO of the column driver IC 21 to drive the transistor Qe of the column driver IC 22. The transistor Qe of the column driver IC 22 is an input side transistor of a current mirror circuit, which includes the transistors Q1 to Qm as output side transistors.

Incidentally, the resistors Ro and Rr have same resistance values and the resistor Rs has a value equal to a value of each of the resistors R1 to Rm. Further, GA1 to GAm indicate control signals for ON/OFF controlling the switches S1 to Sm of the switch block SB of the column driver IC 22.

The column driver IC (or a slave IC) in such circuit as mentioned above responds to a current corresponding to a reference current from the column driver IC (or a master IC) to make the reference currents of the column driver IC's equal. In such case, however, a difference between the reference current IREF of the master column driver IC 21 and the reference current i of the slave column driver IC 22 becomes considerably different since control circuits of the master column driver IC 21 and the slave column driver IC 22, for generating reference currents are the reference current control circuit RC and a drive current output circuit CO, respectively. Therefore, unevenness of luminance in a boarder area of the column driver IC's 21 and 22 can not be removed sufficiently.

A technique for solving such problem is disclosed in JP2003-288045A, in which unevenness of drive current of the column driver IC's is restricted by utilizing a fact that resistance values of integrated, paired resistors are substantially equal.

Since the reference current generator circuit of the master column drive IC and the reference current generator circuit of the slave column driver IC disclosed in JP2001-42827A and JP2003-288045A are different as mentioned above, it is necessary to fabricate the master and slave driver IC's, respectively. Therefore, the fabrication cost of the driver IC's becomes high.

On the other hand, the size of the organic EL panel tends to become larger. For a large display panel, three or more column driver IC's are required presently. Moreover, the increase of the number of terminal pins makes unevenness of drive currents of terminal pins considerable. Therefore, in order to improve unevenness of drive currents, highly precise drive currents are required. As to the drive current control utilizing the paired resistors disclosed in JP2003-288045A, since unevenness of resistance values of the paired resistors influences the drive currents, the use of paired resistors can not respond to the present request of further reduction of luminance unevenness.

SUMMARY OF THE INVENTION

An object of the present invention is to provide an organic EL drive circuit, which is capable of reducing luminance unevenness on a display screen of an organic EL display device due to difference in characteristics between column driver IC's for driving an organic EL panel and of reducing the fabrication cost of column driver IC's.

Another object of the present invention is to provide an organic EL display device using the same organic EL drive circuit.

In order to achieve the above objects, an integrated organic EL drive circuit according to the present invention, which is constructed with a driver IC and generates drive currents, which are to be supplied to terminal pins of the organic EL panel, on the basis of a reference current generated by a reference current generator circuit, is featured by comprising a first input terminal supplied with an externally supplied current, which is in phase with a reference current generated by the reference current generator circuit and has a value corresponding to a value of the reference current, an output terminal, a reference current selector circuit for selecting either the reference current or the external current supplied to the first input terminal, a current inverter circuit for inverting phase of the selected current from the reference current selector circuit with respect to the reference current and a current mirror circuit having an input side transistor supplied with the phase-inverted current from the current inverter circuit and a plurality of first output side transistors for generating drive currents or currents on which the drive currents are generated, which are in phase with the reference current, wherein the current mirror circuit includes a second output side transistor for outputting a current, which is in phase with the reference current and has current values substantially equal to a current value of the current selected by the reference current selector circuit.

According to the present invention, either the current externally supplied to the first input terminal or the reference current generated by the reference current generator circuit, which is in phase with the current supplied to the first input terminal, is selected by the reference current selector circuit. The phase of the thus selected current is temporarily inverted by the current inverter circuit to drive the current mirror circuit, which is a current distributor circuit or a reference current regulator circuit for duplicating and distributing the reference currents. Thus, it is possible to generate currents, which are in phase with the reference current or the external input current and have the same current value as that of the reference or inputted current, in the output side transistors of the current mirror circuit. Therefore, in the present invention, the second output side transistors of the current mirror circuit are provided such that the current substantially equal to the selected current, which is in phase with the reference current, can be outputted from the output terminal of the IC of the present invention as an input reference current to be supplied to a next stage IC. Alternatively, the input reference current from the output terminal of the preceding IC having the same construction of the succeeding IC can be received at the first input terminal thereof.

The IC of the present invention can use either the current inputted to the first input terminal as a reference current or the internally generated reference current. Moreover, it can supply a current, which has a value corresponding to and is in phase with the reference current. Further, it is possible to supply a current, which has a value corresponding to the value of the reference current and is in phase with the latter, from the output terminal to other IC. Therefore, by providing a plurality of IC's having identical construction in the organic EL drive circuits, each IC becomes a slave IC (slave chip) when the IC generates drive currents on the basis of the current supplied to the first input terminal thereof as the reference current or a master IC (master chip) when the IC drives other similar IC by its output terminal current. As a result, the driver IC of an organic EL drive circuit can becomes either the master IC or the slave IC.

The slave IC responds to the current substantially equal to and in phase with the reference current from the output terminal of the master IC to drive the current mirror circuit, which is identical to that of the master IC, through the reference current selector circuit and the current inverter circuit, which are identical to those of the master IC. A circuit from the current inverter circuit, which receives the reference current, to the current mirror circuit of the master IC has the same circuit construction as that of the slave IC. Of course, a circuit subsequent to the current mirror circuit, for generating the drive current can be made identical.

As a result, unevenness of drive currents outputted from the output terminals of the respective IC's is reduced, so that unevenness of luminance on the display screen of the organic EL display device due to variation in characteristics between the column driver IC's, which drive the organic EL panel, is reduced.

Particularly, by arranging a plurality of second output side transistors on an upstream side of the first output side transistors with respect to the input side transistor of the current mirror circuit, the respective second output side transistors can provide reference currents to a plurality of slave IC's. As a result, the master IC can drive the plurality of the slave IC's, so that unevenness of currents outputted from the respective output terminals of the master and slave IC's can be restricted.

By providing two input side transistors in the current mirror circuit on both sides of the first and second output side transistors and driving the first and second output side transistors from the both sides of the output side transistors arrangement, it is possible to reduce difference between the last column line of a certain drive IC as a master drive IC and the first column line of a next drive IC as a slave driver IC, to thereby reduce luminance unevenness on the display screen.

As a result, according to the present invention, unevenness of luminance on the display screen of the organic EL display device of such as a portable telephone set, which is due to difference in characteristics between the column driver IC's for driving the organic EL panel can be reduced even when the number of terminal pins is increased. Further, since any one of the column driver IC's can be used as either the master IC or the slave IC, it is possible to reduce the fabrication cost of the column driver IC's.

Incidentally, the column driver in this specification may be a driver IC for driving data line of the organic EL panel of the active matrix type or a driver IC for driving column lines of the organic EL panel of the passive matrix type.

DETAILED DESCRIPTION OF THE PREFERRED EMBODIMENTS

Figure 1:
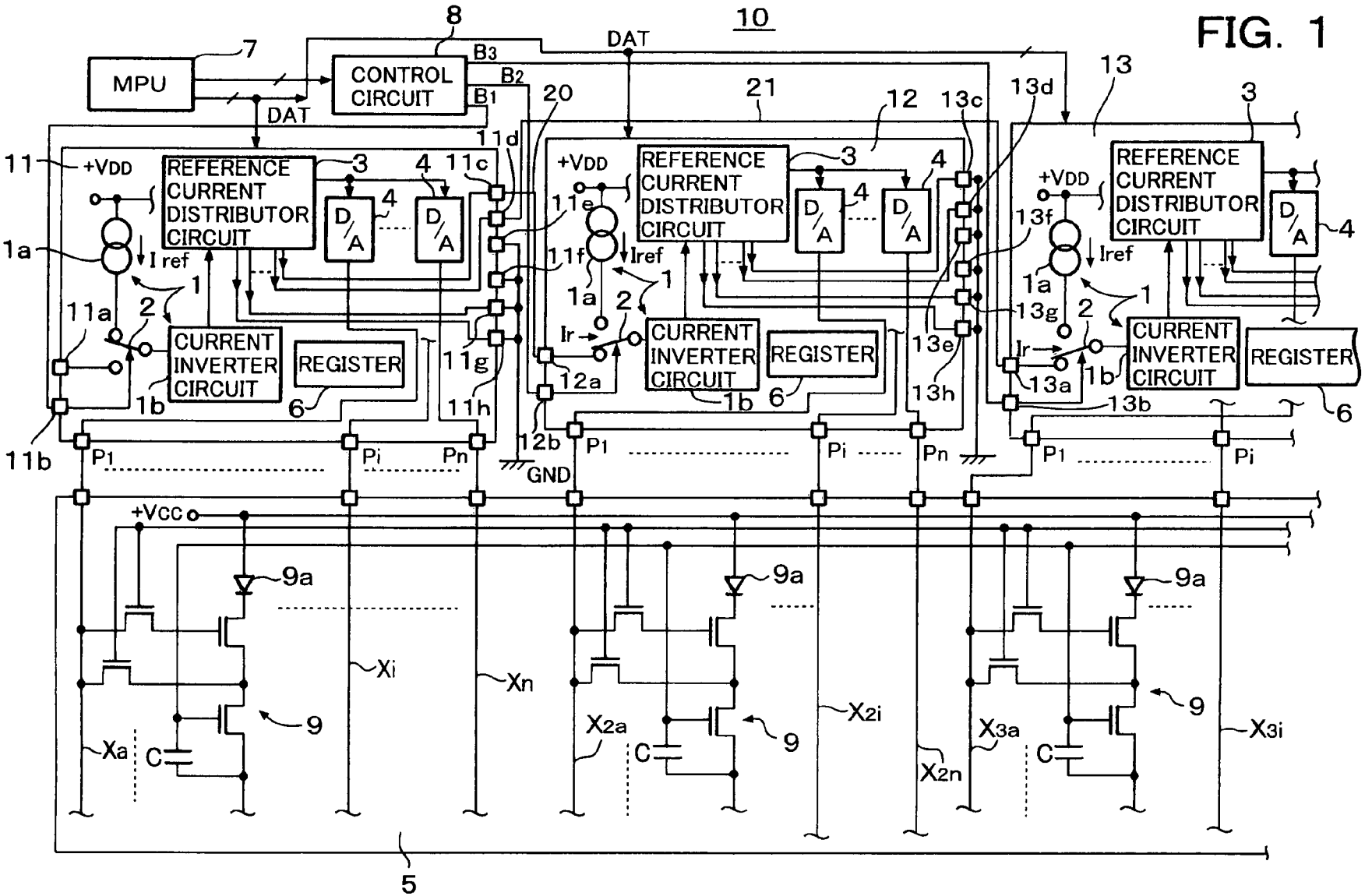
FIG. 1 is a block circuit diagram of an organic EL display device to which an organic EL drive circuit according to an embodiment of the present invention is applied.

In FIG. 1, a reference numeral 10 depicts an organic EL display device of active matrix type and reference numerals 11, 12 and 13 depict column driver IC's of an organic EL drive circuit of the organic EL display device.

Figure 2:
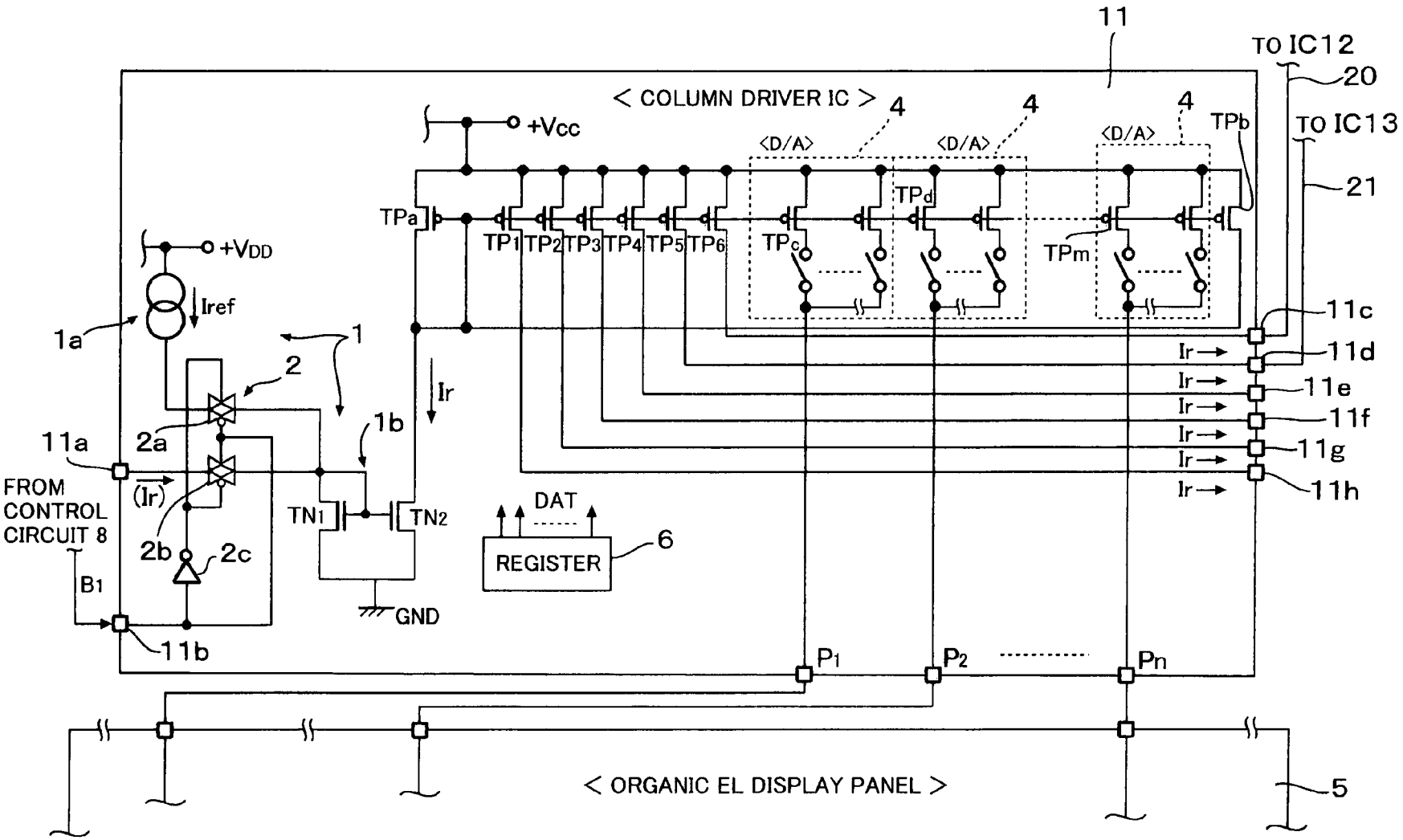
FIG. 2 shows an inside construction of a column driver of the organic EL drive circuit.
Figure 3:
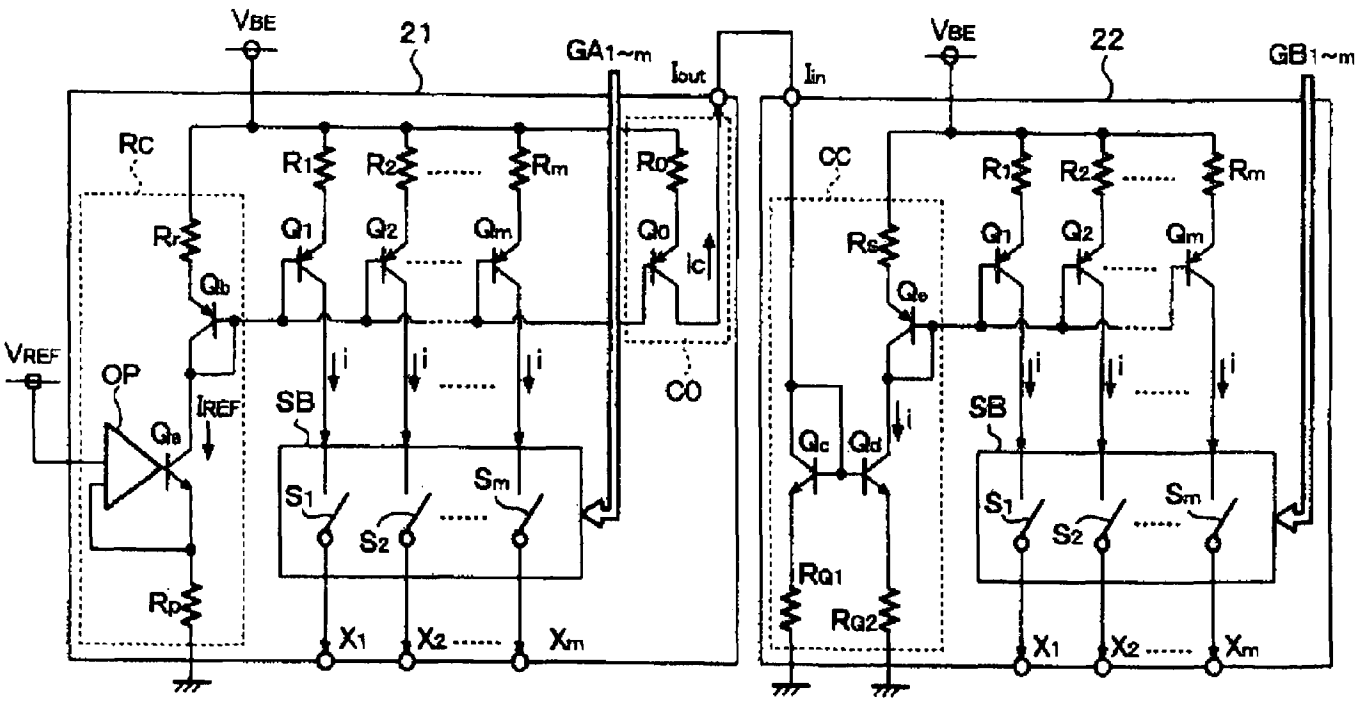
FIG. 3 PRIOR ART
FIG. 3 is a circuit diagram of a conventional organic EL drive circuit using a plurality of column drivers.

The column driver IC's 11 to 13 have identical constructions and each of them, for example, the column driver IC 11, is constructed with a reference current generator circuit 1, a reference current selector circuit 2, a reference current distributor circuit 3 and D/A conversion blocks 4 provided for respective terminal pins of the organic EL panel as shown in detail in FIG. 2.

The D/A conversion blocks 4 of each of the column driver IC's 11, 12 and 13 are responsive to display data DAT from an MPU 7 through a register 6 to amplify a reference drive current generated by the reference current generator circuit 1 according to the display data and generate drive currents (discharge currents) correspondingly to display luminance every moment. The thus generated drive currents are sent to pixel circuits 9 of the active matrix type organic EL panel 5 through output terminals P1, . . . Pi, . . . Pn on the side of data line (column line) to charge capacitors C of the pixel circuits 9 and drives organic EL elements 9*a* of the pixel circuits 9.

Incidentally, each D/A conversion block 4 is a current mirror circuit having an input side transistor, which is an input side transistor of a current mirror circuit constituting the reference current distributor circuit 3, a plurality of output side transistors and a corresponding number of switch circuits (FIG. 2). Thus, the D/A conversion block 4 constitutes a current switching type D/A converter.

Xa, . . . Xi, . . . Xn, X2*a*, . . . X2*i*, . . . X2*n* and X3*a*, . . . X3*i*, . . . X3*n* in FIG. 1 depict data lines (column lines) connected to the respective output terminals P1, . . . Pi, . . . Pn of the column drivers 11, 12 and 13, which correspond to respective pixels for one horizontal line.

Terminals 11*a* and 11*b* are input terminals of the column driver IC 11 and terminals 11*c* to 11*h* are output terminals of the column driver IC 11 provided separately from the output terminals P1, . . . Pi, . . . Pn. For the column driver IC 12, input terminals 12*a* and 12*b* and output terminals 12*c* to 12*h* are provided correspondingly to the input terminals 11*a* and 11*b* and the output terminals 11*c* to 11*h* of the column driver IC 11. Similarly, input terminals 13*a* and 13*b* and output terminals 13*c* to 13*h* are provided in the column driver 13. For a color display, the reference current distributor circuit 3 and the D/A conversion blocks 4 are provided for each of R, G and B colors.

Within the reference current distributor circuit 3 or between the reference current generator circuit 1 and the reference current distributor circuit 3, reference current regulator circuits (not shown) are provided correspondingly to respective R, G and B colors. The reference drive current generated by the reference current generator circuit 1 is regulated by these reference current regulator circuits to regulate white balance on the display screen.

Since difference between these primary colors and reference current regulator circuits therefor are not directly related to the present invention, one of the reference current regulator circuits will be described generally.

As shown in FIG. 2, the reference current generator circuit 1 is constructed with a reference current source 1*a* and a current inverter circuit 1*b*. The reference current selector circuit 2 is provided between the reference current source 1*a* and the current inverter circuit 1*b*. The reference current selector circuit 2 is constructed with analog switches (transmission gates) 2*a* and 2*b* and an inverter 2*c*. The analog switch 2*a* is provided between the reference current source 1*a* and the current inverter circuit 1*b* and the switch 2*b* is provided between the input terminal 11*a* and the current inverter circuit 1*b*.

The inverter 2*c* has an input side terminal connected to the input terminal 11*b* and an output side terminal connected to a non-inversion side input terminal of the analog switch 2*a* for receiving ON/OFF control signal and an inversion side input terminal of the analog switch 2*b* for receiving ON/OFF control signal. Further, the input terminal 11*b* is directly connected to the inversion side input terminal of the analog switch 2*a* for receiving ON/OFF control signal and the non-inversion input terminal of the analog switch 2*b* for receiving the ON/OFF control signal.

Therefore, when a "0" bit is inputted to the input terminal 11*b*, the analog switch 2*a* is turned ON and the analog switch 2*b* is turned OFF complementarily. In such situation, a reference current Iref of the reference current source 1*a* is supplied to the current inverter circuit 1*b*. On the other hand, when a "1" bit is inputted to the input terminal 11*b*, the analog switch 2*b* is turned ON and the analog switch 2*a* is turned OFF. In such case, a current Ir, which is supplied to the input terminal 11*a* externally of the column driver IC 11 and is in phase with the reference current Iref, is sent to the current inverter circuit 1*b*.

Incidentally, as shown in FIG. 1, selection bit signals B1, B2 and B3 for selecting reference current value are supplied from control circuits 8 to the input terminals 11*b*, 12*b* and 13*b* of the respective column driver IC's, respectively. The reference current source 1*a* is powered to a power source line +VDD.

Returning to FIG. 2, the current inverter circuit 1*b* is constructed with a current mirror circuit including an input side N channel MOS transistor TN1 and an output side N channel MOS transistor TN2. The diode-connected transistor TN1 has a drain connected to output terminals of the analog switches 2*a* and 2*b* and a source grounded.

The N channel MOS transistor TN2 has a drain connected to drains of input side transistors TPa and TPb provided in both end portions of the current mirror circuit forming the reference current distributor circuit 3 and a source grounded.

Therefore, either the reference current Iref of the reference current source 1*a* or the current Ir, which is supplied externally to the input terminal 11*a* and is in phase with the reference current Iref, is inputted to the current inverter circuit 1*b*. The current inverter circuit 1*b* inverts the phase of the reference current Iref or the current Ir to generate a sink current (output current), which is phase-inverted output current, as a mirror current. The mirror current is supplied to the drains of the input side transistors TPa and TPb of the reference current distributor circuit 3.

The reference current distributor circuit 3 is constructed with diode-connected input side P channel MOS transistors TPa and TPb, 6 (six) output side P channel MOS transistors TP1 to TP6 and the D/A conversion blocks 4 provided correspondingly to the respective output terminals P1, . . . Pi, . . . Pn and acts as a current duplicator/distributor circuit for duplicating an input side current as mirror currents on the output side thereof and distributing the mirror currents to the respective terminal pins.

The D/A conversion blocks 4 converts the display data into analog data and the output transistors thereof act as the output side transistors of the reference current distributor circuit 3. That is, a single current mirror circuit is constructed with the reference current distributor circuit 3 and the D/A conversion blocks 4 as shown in FIG. 1 and constitutes a reference current distribution type D/A converter circuit, as shown in FIG. 2.

Each of TPc to TPm in the D/A conversion blocks 4 indicates a plurality of output side P channel MOS transistors, which are current mirror connected to the input side P channel MOS transistors TPa and TPb.

Sources of the output side transistors TP1 to TP6 provided on the upstream side of the D/A conversion blocks 4 and sources of the output side transistors TPc to TPm of the D/A conversion blocks 4 are connected to the power source line +Vcc, voltage of which is higher than the voltage of the power source line +VDD. Drains of the transistors TP1 to TP6 are connected to the output terminals 11*c* to 11*h*, respectively.

Since the output side transistors TPc to TPm of the D/A conversion blocks 4 constitute the current mirror circuits together with the input side transistors TPa and TPb of the reference current distributor circuit 3, the D/A conversion blocks form the current switching D/A converter circuits, respectively. The output side transistors of each current switching D/A converter circuit are weighted correspondingly to weights of the 8-bit display data and switch circuits are connected in series with the weighted output side transistors, respectively.

Thus, each of the output side transistors TPc to TPm of the D/A conversion blocks 4 corresponds to one of the output side transistors having 8-bit weights. The switch circuits connected in series with the output side transistors shown in FIG. 2, respectively, are ON/OFF controlled according to the display data.

The D/A conversion blocks 4 are provided correspondingly to the respective terminal pins and the output terminals of the D/A conversion block 4 are connected to the output terminals P1, . . . Pi, . . . Pn, respectively.

The output currents of the output side transistors of each D/A conversion block 4 are selected by the respective switch circuits, which are ON/OFF controlled by the display data DAT in the register 6 and a sum of the selected output currents of the D/A conversion block 4 is generated as an analog-converted value. The sums are outputted from the D/A conversion blocks to the output terminals P1, . . . Pi, . . . Pn as drive currents, respectively.

The transistors TP1 to TP6 constitute a circuit for sending the reference currents to the driver IC's, which are slave IC's. Positions of the transistors TP1 to TP6 with respect to the input side transistor TPa are on an upstream side of the output side transistors TPc to TPm of the D/A conversion blocks 4. On the other hand, the input side transistor TPb is provided on a downstream side of the last output side transistor of the last D/A conversion block 4. Incidentally, the input side transistor TPb may be arranged before or after the last output side transistor TPm.

Although the number of the transistors TP1 to TP6 is 6 in this embodiment, the number of the transistors TPc to TPh is as large as several tens. Therefore, preciseness of the output currents of these transistors is improved by arranging the transistors TP1 to TP6 in the vicinity of the transistor TPa.

Therefore, preciseness of the output current of the transistor TPm remote from the input side transistor TPa is degraded correspondingly to the distance between the transistor TPm and the input side transistor TPa. However, it is possible to restrict unevenness of the output currents of the transistors TPc to TPm by providing the input side transistor TPb in the vicinity of or after the output side transistor TPm. Therefore, the difference in unevenness of the drive current of the transistor TPc corresponding to the initial column line (data line), which correspond to an initial terminal pin, of the succeeding slave IC is reduced by making the output current of the last output side transistor TPm substantially equal to the output current of the initial output side transistor TPc.

Incidentally, transistor cells provided in an edge portion of an area of a driver IC are usually dummy transistors, which are not used in the circuit for generating drive currents to be supplied to the terminal pins, since the operating characteristics of the transistor cell is somewhat different from that of transistor cells provided inside of the driver IC.

The dummy transistors, which are provided in both end portions of the IC area in which the output side transistors TP1 to TP6 and TPc to TPm are provided, can be used as the input side transistors TPa and TPb positioned on both sides of the line of the output side transistors of the current mirror circuit.

In such case, the input side transistors TPa and TPb, which are arranged in both side portions of the area of the output side transistors TP1 to TP6 and TPc and TPm, can drive the output side transistors from the both sides.

As shown in FIG. 1, the driver IC 11 acts as the master IC for generation of the reference current and the drivers 12 and 13 act as slave IC's responsive to the reference current Ir supplied from the driver IC 11. Channel width (gate width) ratio of each of the input side transistors TPa and TPb with respect to each of the transistors TP1 to TP6 is 1:1. The reference currents Ir, each of which is substantially equal to the reference current Iref and is in phase with the reference current Iref, are outputted from drains of the transistors TP1 to TP6 to the output terminals 11*c* to 11*h* as discharge currents, respectively.

The drain current of the transistor TP1 is inputted to the input terminal 12*a* of the slave IC12 through the output terminal 11*c* and a wiring line 20 (FIG. 1) and the drain current of the transistor TP2 is inputted to the input terminal 13*a* of the slave IC 13 through the output terminal 11*d* and a wiring 21 (FIG. 1).

Other output terminals 11*e* to 11*h* are grounded. Incidentally, since the output currents of the transistors TP1 to TP6 and TPc to TPm are in the order of μA, a total power consumption is not substantially increased even when these currents flow to the ground GND.

This is also true for the output terminals 13*e* to 13*h* of the driver IC 13.

Since the driver IC 11 is the mater IC, there is no current from the input terminal 12*a*. Therefore, the reference current source 1*a* is selected according to a selection bit signal B1 (="0") from the control circuit 8. Thus, the reference current Iref from the reference current source 1*a* is inputted to the current inverter circuit 1*b*. In this case, since the bit "0" corresponds to a state in which there is no input signal, the selection of the reference current source 1*a* is possible even without the selection bit signal B1. Incidentally, in this case, it is preferable to pull down the input terminal 12*a* to the ground GND through a resistor.

On the other hand, the driver IC 12 of the slave IC responds to a selection bit signal B2 (="1") from the control circuit 8 to select the reference current Iref not from the reference current source 1*a* but from the input terminal 12*a*. Therefore, the reference current Ir, which is distributed to the drain of the transistor TP6 of the driver IC 11, is inputted to the current inverter circuit 1*b* of the driver IC 12.

The driver IC 13 of the slave IC responds to a selection bit signal B3 (="1") from the control circuit 8 to select the input terminal 13*a*, so that the reference current Ir from the drain of the transistor TP5 of the driver IC 11 is inputted to the current inverter circuit 1*b* of the driver IC 13.

Therefore, each of the driver IC's 11, 12 and 13 drives the input side P channel MOS transistors TPa and TPb of the reference current distributor circuit 3 by the reference current Ir, which corresponds to the reference current Iref of the reference current generator circuit 1 thereof and is in phase with the reference current Iref, through the current inverter circuit 1*b*.

As a result, the D/A conversion block 4 of the reference current distributor circuits 3 of the driver IC's 12 and 13 of the slave IC generate the drive currents, which are to be supplied to the terminal pins of the organic EL panel on the basis of the reference current Ir.

In such case, each of the driver IC's 12 and 13 of the slave chip responds to the currents Ir, which are substantially equal to the reference current Iref and are in phase with the reference current Iref, from the output terminals corresponding to the output terminals 11*c* and 11*d* of the master driver IC 11 to drive the current mirror circuit constituting the reference current distributor circuit 3 and the D/A conversion blocks 4 through the reference current selector circuit 2 and the current inverter circuit 1*b*.

As described, the slave driver IC's 12 and 13 generate the drive currents through the circuits constructed similarly to that of the master driver IC 11 with using the reference current Iref of the reference current generator circuit 1*a* of the driver IC 11 as reference, so that unevenness of the drive currents is reduced.

In this embodiment, the reference current selector circuit 2 selects either the internal reference current Iref or the externally inputted current Ir, according to the setting signal from the control circuit 8. However, the reference current selector circuit 2 may select the reference current Iref or the current Ir by forming a contact wiring pattern in a layer, in which a ROM is formed, such that the reference current selector circuit 2 can be connected to a contact on the side to be selected at the same time when data is written in the ROM. In such case, the reference current selector circuit 2 can be made a selector current, which is selected in the mask option processing of the fabrication steps when data is written in the ROM. Therefore, in such case, there is no need of inputting bit data for selection to the reference current selector circuit 2. Further, there is no need of a hardware circuit including special logic circuit, etc., in this wiring connection. Alternatively, the reference current selector circuit may be constructed such that it includes fuses in respective wiring lines and the fuses are selectively cut in the fabrication step of the drive circuit.

By constructing the drive circuit in such a way that the selection of either the master IC or the slave IC can be done according to the selection bits B1, B2 and B3 as in the described embodiment, it is possible to select optimal one of the internal reference current Iref and the externally inputted current Ir, after the driver IC's are assembled in the display device and unevenness of luminance is watched on the display screen.

Further, although, in the described embodiment, the 6 input side transistors TP1 to TP6 of the reference current distributor circuit 3, which are arranged in the vicinity of the input side transistor, are assigned to the output side transistors for generating the reference currents with respect to 6 slave driver IC's, the output side transistors may be substituted by a single output side transistor or a plurality of output side transistors the number of which is larger than 6.

Further, since, in the described embodiment, the input side transistors TPa and TPb arranged on both sides of the output side transistors TP1 to TP6 drive the latter output side transistors, any one of the output side transistors TP1 to TP6 can output the reference currents Ir.

Since each of the slave driver IC's 12 and 13 has a construction identical to that of the master driver IC 11, one of the driver IC's 12 and 13 distributes the reference current Ir to the drains of the other slave IC. Of course, a plurality of master driver IC's may be used correspondingly to luminance unevenness on the screen.

When, in order to regulate white balance, the reference current regulator circuit is provided for each of R, G and B colors, the reference current distributor circuits 3 each shown in FIG. 2 can be used. That is, the D/A conversion block 4 is provided for each of R, G and B colors and all of the three D/A conversion blocks 4 are used as the reference current regulator circuit. This is because the three D/A conversion blocks 4 as the reference current regulator circuit can generate the reference drive currents corresponding to respective R, G and B colors by D/A converting a predetermined setting data.

The reference current regulator circuit for regulating white balance can be realized by a current mirror circuit constructed with one reference current distributor circuit 3 and three D/A conversion blocks 4 for R, G and B colors. In such case, it is necessary to separately provide reference current distributor circuits corresponding to the respective terminal pins. This is because the reference current distributor circuit, which is the current mirror circuit constructed with the reference current distributor circuits 3 and the D/A conversion blocks 4 is provided on the downstream side of each of the three D/A conversion blocks 4. In this case, however, the input side P channel MOS transistors TPa and TPb and the plurality of the output side P channel MOS transistors TPc to TPm of the current mirror circuit constituting the reference current distributor circuit 3 and the D/A conversion blocks 4 shown in FIG. 2 become input side N channel MOS transistors, respectively. The source side of the current mirror circuit is grounded and drains of the output side N channel MOS transistors TPc to TPm are connected to the output terminals, so that it becomes the current sink type output circuit. The drains of the N channel MOS transistors TPa and TPb receive the reference drive currents Ir from the reference current regulator circuit.

In the described embodiment, the master driver IC 11 is provided in an initial stage of the drive circuit and the slave driver IC's 12 and 13 are provided on the downstream side thereof. However, the position of the master driver IC 11 is not limited to the initial stage of the drive circuit. Particularly, when there are plural slave driver IC's, the master driver IC 11 may be arranged at a center position of a line of the slave drivers in such order of, for example, the slave driver IC 12, the master driver IC 11 and the slave driver IC 13.

In the reference current distributor circuit (current mirror circuit) of the described embodiment, the reference currents Ir are generated in the output side transistors of the current mirror circuit and distributed to the output terminals 11*c* to 11*h* and the terminal pins P1 to Pn, respectively. In such case, it is possible to generate not the current value Ir but current K×Ir by changing the channel width (gate width) ratio of the input side transistor to each output side transistor of the D/A converter circuit, where K may be smaller than 1. Further, it is possible to provide the D/A conversion block corresponding to R, G and B colors in a different manner from the described reference current regulator circuit and regulate white balance on the screen by regulating the reference drive current thereby.

Further, the current drive circuit of the described embodiment includes two input side drive transistors and a number of output side transistors. However, it can be constructed with a single input side transistor or input side transistors more than 2.

Further, although the drive circuit of the described embodiment is constructed with mainly MOS FET's, it can be constructed with bipolar transistors. Further, the N channel transistors (or npn type transistors) may be replaced by P channel (or pnp) transistors and the P channel (or pnp) transistors may be replaced by N channel (npn) transistors.

What is claimed is:

1. An integrated organic EL drive circuit for driving an organic EL panel with drive currents generated correspondingly to terminal pins of said organic EL panel on a basis of a reference current generated by a reference current generator circuit, comprising:

a first input terminal supplied with a current externally of said integrated organic EL drive circuit, the current being in phase with the reference current and having a value corresponding to a value of the reference current;

an output terminal;

a reference current selector circuit for selecting either the current or the reference current;

a current inverter circuit for inverting a phase of an output of said reference current selector circuit with respect to the reference current; and a current mirror circuit including an input side transistor, a plurality of first output side transistors and a second output side transistor, said current mirror circuit responsive to an output current of said current inverter circuit, for generating the drive currents or currents, which is in phase with the reference current and from which the drive currents are obtained, at the plurality of said first output side transistors, said second output side transistor for outputting a current, which is in phase with the reference current and has values substantially equal to a value of the current selected by said reference current selector circuit, to said output terminal.

2. The integrated organic EL drive circuit as claimed in claim 1, wherein said second output side transistor is arranged on an upstream side of said first output side transistors with respect to said input side transistor.

3. The integrated organic EL drive circuit as claimed in claim 2, wherein said output current of said second output side transistor is supplied to a first input terminal of another integrated organic EL drive circuit having an identical construction to that of said integrated organic EL drive circuit.

4. The integrated organic EL drive circuit as claimed in claim 2, wherein said first input terminal is supplied with an output current of the second output side transistor of another integrated organic EL drive circuit having identical construction to that of said integrated organic EL drive circuit.

5. The integrated organic EL drive circuit as claimed in claim 3, wherein the plurality of said first output side transistors are provided correspondingly to said terminal pins, respectively, and the drive currents or the currents from which the drive currents are obtained are generated correspondingly to said terminal pins, respectively.

6. The integrated organic EL drive circuit as claimed in claim 4, wherein the plurality of said first output side transistors are provided correspondingly to said terminal pins, respectively, the drive currents or the currents from which the drive currents are obtained are generated correspondingly to said terminal pins, respectively, and said current inverter circuit is constituted with a current mirror circuit.

7. The integrated organic EL drive circuit as claimed in claim 2, wherein said reference current selector circuit responds to a predetermined selection signal inputted by a selection of connecting wirings in a fabrication step of said organic EL drive circuit or externally of said organic EL drive circuit through a second input terminal to select either the inputted current or the reference current.

8. The integrated organic EL drive circuit as claimed in claim 7, wherein a plurality of said input side transistors, a plurality of said second output side transistors and a plurality of said output terminals are provided, at least two of said input side transistors are arranged in opposite end portion of a transistor arrangement of said first and second output side transistors to drive said first and said second output side transistors and said second output side transistors are arranged on an upstream side of said first output side transistors with respect to either one of said input side transistors.

9. The integrated organic EL drive circuit as claimed in claim 8, wherein said reference current selector circuit is constructed with two analog switches, one end of one of said analog switches is connected to said reference current generator circuit and the other end of said analog switch is connected to said first input terminal and the other ends of said analog switches are commonly connected to said current inverter circuit, said analog switches being complementarily ON/OFF controlled by 1-bit signal.

10. The integrated organic EL drive circuit as claimed in claim 7, wherein said input side transistors and said plurality of said first output side transistors constitute a D/A converter circuit and the plurality of said first output side transistors form a D/A conversion block of said D/A converter circuit.

11. The integrated organic EL drive circuit as claimed in claim 10, wherein said current mirror circuit is constituted with P channel MOS transistors and a plurality of said D/A conversion blocks are provided correspondingly to said terminal pins, respectively.

12. The integrated organic EL drive circuit as claimed in claim 8, wherein said current mirror circuit is constituted with P channel MOS transistors and a plurality of said D/A conversion blocks are provided correspondingly to red, green and blue colors, respectively, to form a circuit for regulating the reference currents correspondingly to red, green and blue colors, respectively.

13. An organic EL drive circuit including a plurality of integrated circuits for driving an organic EL panel with drive currents generated correspondingly to terminal pins of said organic EL panel on the basis of a reference current generated by a reference current generator circuit, each of said integrated circuits comprising:

a first input terminal supplied with a current externally of said integrated organic EL drive circuit, the current being in phase with the reference current and having a value corresponding to a value of the reference current;

an output terminal;

a reference current selector circuit for selecting either the current or the reference current;

a current inverter circuit for inverting a phase of an output of said reference current selector circuit with respect to the reference current; and a current mirror circuit including an input side transistor, a plurality of first output side transistors and a second output side transistor, said current mirror circuit responsive to an output current of said current inverter circuit, for generating the drive currents or currents, which is in phase with the reference current and from which the drive currents are obtained, at the plurality of said first output side transistors, said second output side transistor for outputting a current, which is in phase with the reference current and has values substantially equal to a value of the current selected by said reference current selector circuit, to said output terminal, wherein the output current of said second output side transistor of one of the plurality of said integrated circuits is inputted to said first input terminal of at least one of the remaining integrated circuits through said output terminal.

14. The organic EL drive circuit as claimed in claim 13, wherein said output side transistors of each said integrated circuit are arranged on an upstream side of said first output side transistors with respect to said input side transistor.

15. The organic EL display device as claimed in claim 14, wherein said the plurality of said first output side transistors of each said integrated circuit are provided correspondingly to said terminal pins and the drive currents or the currents from which the drive currents are obtained are generated correspondingly to said terminal pins assigned for said integrated circuit.

16. The organic EL drive circuit as claimed in claim 14, wherein said reference current selector circuit selects either the inputted current or the reference current by a selection of connecting wiring in the fabrication step or according to an external predetermined selection signal through said input terminal.

17. An organic EL display device including a plurality of integrated circuits for driving an organic EL panel with drive currents generated correspondingly to terminal pins of said organic EL panel on the basis of a reference current generated by a reference current generator circuit, each of said integrated circuits comprising:

a first input terminal supplied with a current externally of said integrated organic EL drive circuit, the current being in phase with the reference current and having a value corresponding to a value of the reference current;

an output terminal;

a reference current selector circuit for selecting either the current or the reference current;

a current inverter circuit for inverting a phase of an output of said reference current selector circuit with respect to the reference current; and a current mirror circuit including an input side transistor, a plurality of first output side transistors and a second output side transistor, said current mirror circuit responsive to an output current of said current inverter circuit, for generating the drive currents or currents, which is in phase with the reference current and from which the drive currents are obtained, at the plurality of said first output side transistors, said second output side transistor for outputting a current, which is in phase with the reference current and has values substantially equal to a value of the current selected by said reference current selector circuit, to said output terminal, wherein the output current of said second output side transistor of one of the plurality of said integrated circuits is inputted to said first input terminals of at least one of the remaining integrated circuits through said output terminal.

18. The organic EL display device as claimed in claim 17, wherein said output side transistors of each said integrated circuit are arranged on an upstream side of said first output side transistors with respect to said input side transistor.

19. The organic EL display device as claimed in claim 18, wherein said the plurality of said first output side transistors of each said integrated circuit are provided correspondingly to said terminal pins and the drive currents or the currents from which the drive currents are obtained are generated correspondingly to said terminal pins assigned for said integrated circuit.

20. The organic EL display device as claimed in claim 18, wherein said reference current selector circuit selects either the inputted current or the reference current by a selection of connecting wiring in the fabrication step or according to an external predetermined selection signal through said input terminal.

* * * * *